US011263986B2

(12) United States Patent
Blaker et al.

(10) Patent No.: US 11,263,986 B2
(45) Date of Patent: Mar. 1, 2022

(54) SYSTEM AND METHOD FOR DISPLAY FAULT MONITORING

(71) Applicant: GENTEX CORPORATION, Zeeland, MI (US)

(72) Inventors: David A. Blaker, Holland, MI (US); Justin D. Jansen, Hudsonville, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 17/235,089

(22) Filed: Apr. 20, 2021

(65) Prior Publication Data

US 2021/0327371 A1 Oct. 21, 2021

Related U.S. Application Data

(60) Provisional application No. 63/012,577, filed on Apr. 20, 2020.

(51) Int. Cl.
*G09G 3/36* (2006.01)

(52) U.S. Cl.
CPC ..... *G09G 3/36* (2013.01); *G09G 2330/08* (2013.01); *G09G 2330/12* (2013.01); *G09G 2380/10* (2013.01)

(58) Field of Classification Search
CPC ..... G09G 2330/08
See application file for complete search history.

(56) References Cited

U.S. PATENT DOCUMENTS

| | | | | |
|---|---|---|---|---|
| 6,784,862 | B2 | 8/2004 | Kodate et al. | |
| 6,816,143 | B1 | 11/2004 | Lambert | |
| 7,053,645 | B2 | 5/2006 | Chung | |
| 7,994,903 | B2 | 8/2011 | Yamazaki | |
| 2007/0257872 | A1* | 11/2007 | Huibers | G09G 3/007 345/84 |
| 2013/0342229 | A1 | 12/2013 | Wang | |
| 2015/0379910 | A1* | 12/2015 | Nishinohara | G09G 3/3241 345/206 |

OTHER PUBLICATIONS

International Search Report dated Aug. 19, 2021, for corresponding PCT application No. PCT/US2021/028106, 3 pages.
Written Opinion dated Aug. 19, 2021, for corresponding PCT application No. PCT/US2021/028106, 5 pages.

* cited by examiner

*Primary Examiner* — Gustavo Polo
(74) *Attorney, Agent, or Firm* — Price Heneveld LLP; Brian James Brewer

(57) ABSTRACT

A display device for a vehicle comprises a pixel array comprising a plurality of display elements. The device further comprises at least one test element and a controller. The controller is configured to selectively activate the display elements of the pixel array via a plurality of control signals and identify the activation of the at least one test element in response to at least one of the control signals. The controller is further configured to identify a display fault of the display device by comparing the at least one control signal communicated to the at least one test element to a diagnostic signal communicated from the at least one test element.

19 Claims, 12 Drawing Sheets

SYSTEM AND METHOD FOR DISPLAY FAULT MONITORING

CROSS REFERENCE TO RELATED APPLICATIONS

This application claims the benefit of and priority to U.S. Provisional Patent Application No. 63/012,577, filed on Apr. 20, 2020, entitled System and Method for Display Fault Monitoring, the entire disclosure of which is hereby incorporated herein by reference.

FIELD OF THE DISCLOSURE

The present disclosure relates generally to a video display device and, more particularly, relates to fault detection apparatus for a video display device.

BACKGROUND

A failure of a display in a full display mirror may result in misleading information being depicted. For example, if a display panel in a vehicle fails at night, the lack of information displayed (e.g., a black screen) may lead an operator to believe that there are no vehicles following. Alternatively, if a wiring or communication fault occurs, the display may depict a scene mirrored such that the information could lead an operator to control the vehicle in error.

SUMMARY

According to one aspect of the disclosure, a display device for a vehicle is disclosed. The display device may comprise a pixel array comprising a plurality of display elements; at least one test element; and at least one controller. The controller may be configured to selectively activate the display elements of the pixel array via a plurality of control signals; identify the activation of the at least one test element in response to at least one of the control signals; and identify a display fault of the display device by comparing the at least one control signal communicated to the at least one test element to a diagnostic signal communicated from the at least one test element.

The controller may be configured to selectively display a health indicator. The health indicator may indicate whether the system is working properly.

The controller may be configured to monitor a feedback signal from at least one of the gate and source drivers. This may enable the controller to monitor the operation of the system.

The system may comprise warning messages in portions of the addressable locations of the pixel array disposed so as not to be visible in the display region when the display is operating properly and so as to be displayed on the display if there is a mirror fault.

The at least one test element may be disposed inside an active area of the display. The at least one test element may additionally, or alternatively, be disposed outside the active area of the display.

The at least one test element may form a portion of the pixel array and may be positioned along a perimeter of the pixel array. The device may further comprise a mask extending along the perimeter of the pixel array and shielding the at least one test element from a display region of the display device. The at least one test element may comprise a non-illuminating test pixel configured to detect a voltage output from a transistor in response to the control signals.

The non-illuminating test pixel may comprise an amplifier configured to detect the voltage output from the transistor and to communicate the diagnostic signal identifying the voltage output to the at least one controller.

The at least one test element may comprise at least one of the plurality of display elements and a light sensor. The at least one test element may comprise a light sensor; and the light sensor may be configured to detect an illumination level of the at least one of the plurality of display elements and to communicate the diagnostic signal identifying the illumination level to the at least one controller. The controller may be configured to receive diagnostic signals from the light sensor. The at least one test element and the plurality of display elements receive control and operation information over a shared communication interface. The operation of the at least one test element may be monitored for display accuracy via one or more sensor elements disposed about the pixel array. The sensor elements may include devices that are operable to detect the activity of one or more of the test elements; and the controller may be configured to detect activity of the at least one test element in order to detect representative operation of a plurality of display elements.

The controller may be configured to control a test program, which controls a lighting pattern of the at least one test element. During the operation of the lighting pattern, the controller may be configured to monitor the operation of the at least one test portion based on information captured and communicated from the one or more sensor elements.

The test elements may share driving circuitry and data connections with the plurality of display elements; and the test elements may be operable to detect failures of one or more segments of the pixel array, orientation errors, display failures, color or radiance inaccuracies and other display failures. The at least one test element and at least one display element may be connected to the same gate lines and source lines and the at least one test element and the at least one display element may both be configured to respond similarly to inputs and to provide diagnostic information identifying the operation of the display elements.

The at least one test element may comprise at least one non-illuminating test element configured to detect the operation of the display. The at least one non-illuminating test element may be configured to detect the delivery of control signals and to output a diagnostic signal to the controller to identify the operation. The at least one test element additionally may comprise at least one illuminating test elements; and the at least one illuminating test element may be configured to monitor the operation of the display and to output a diagnostic signal to the controller to identify the error state. The diagnostic information provides feedback that identifies operation of portions of the pixel array; and the controller may be configured to monitor and process the diagnostic signals to determine whether there is a failure of the display. The controller may be configured to, upon determining there is a failure of the display, one of deactivate the display and cause the generation of a notification that there is a failure of the display.

According to another aspect, a method of detecting faults in a display device, may comprise activating a display element of a pixel array via a plurality of control signals; identifying the activation of at least one test element in response to at least one of the control signals; comparing the at least one control signal communicated to the at least one test element to a diagnostic signal communicated from the at least one test element; identifying a display fault of the display device based on the comparison of the control signal and the diagnostic signal.

The method further may comprise the steps of detecting, by at least one test element, a voltage output from a transistor in response to the control signal; and communicating the diagnostic signal identifying the voltage output to a controller. The method further may comprise activating a backlight to emit light into a liquid crystal display panel; detecting the light with a light sensor; and generating and communicating diagnostic signals to a controller.

The method further may comprise detecting, by a light sensor, an illumination level of the at least one of the plurality of display elements and communicating the diagnostic signal identifying the illumination level to the at least one controller. The at least one test element may comprise the light sensor. The method further may comprise monitoring the operation of the at least one test element for display accuracy via one or more sensor elements disposed about the pixel array. The sensor elements may include devices that are operable to detect the activity of one or more of the test elements; and the controller may be configured to detect activity of the at least one test element in order to detect representative operation of a plurality of display elements. The method further may comprise controlling a test program, which controls a lighting pattern of the at least one test element. During the operation of the lighting pattern, the controller may be configured to monitor the operation of the at least one test portion based on information captured and communicated from the one or more sensor elements. The method further may comprise detecting, by the test elements, failures of one or more segments of the pixel array, orientation errors, display failures, color or radiance inaccuracies and other display failures. The method further may comprise detect the delivery of control signals and outputting a diagnostic signal to the controller to identify the operation. The at least one test element may be configured to detect the operation of the display. The method further may comprise monitoring, by the at least one test element the operation of the display and outputting a diagnostic signal to the controller to identify the error state.

The method further may comprise providing feedback by the diagnostic information that identifies operation of portions of the pixel array. The method further may comprise processing, by the controller, the diagnostic signals to determine whether there is a failure of the display. The method further may comprise causing, by the controller upon a determination there is a failure of the display, one of the deactivation of the display and the generation of a notification that there is a failure of the display.

DETAILED DESCRIPTION

Referring to FIGS. 1A, 1B, 1C, and 2, a system detecting errors or failures in electronic image or video displays is generally shown at 10. The errors of video display 12, if uncorrected, may result in misleading information being depicted on the display 12. For example, if a display 12 is utilized to display information captured by a camera 14 (e.g. a rearview or reverse camera) for a vehicle 16, the lack of information displayed (e.g. a black screen) may lead the operator to believe that there is no traffic approaching from the rear of the vehicle.

Figure 2:
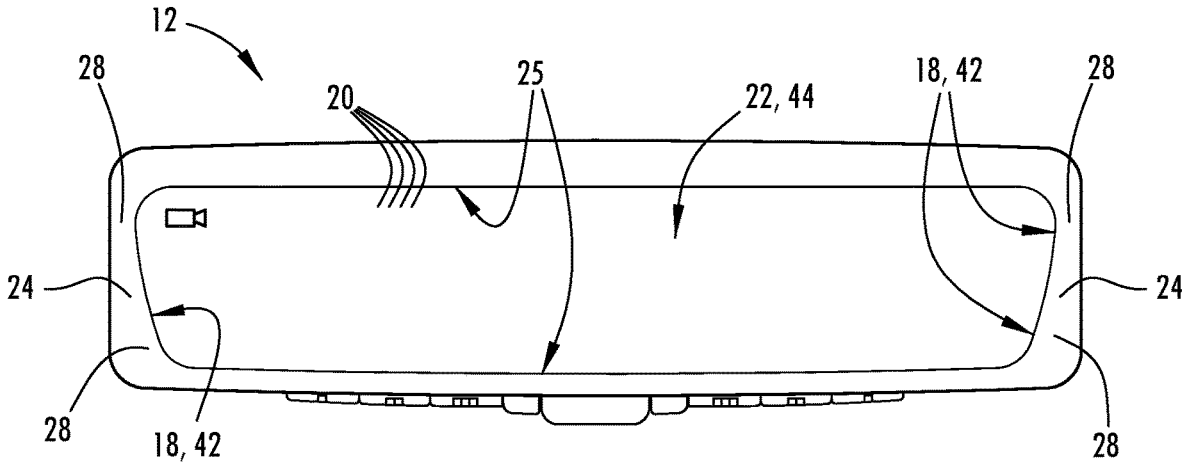
FIG. 2 is a front view of the display device demonstrating a test region and a display region.

More specifically, if a display is utilized as a rearview display as shown in FIG. 2 to depict an environment proximate the vehicle 16, a display error may result in an inaccuracy or misrepresentation of the local environment. Such errors may be the result of damage to the display 12, a wiring fault or other communication faults. Such faults may result in the display 12 depicting image data mirrored, flipped, or otherwise altered in orientation, or with missing image data, or may cause the display 12 to be inoperable. Accordingly, the disclosure provides for the system 10 configured to monitor and detect a variety of display errors or failures such that the defective operation may be communicated to an operator of the vehicle 16 or other viewer.

Figure 1A:
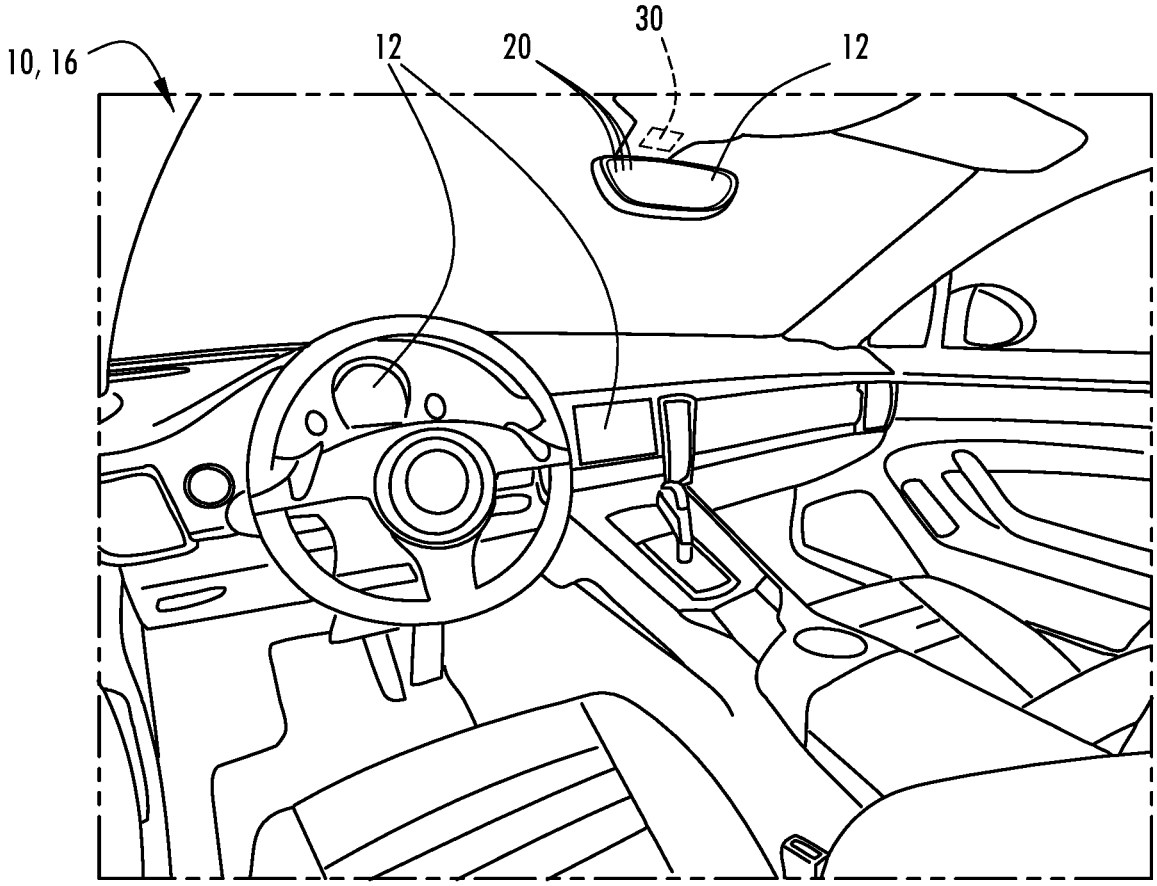
FIG. 1A is a projected view demonstrating an interior of a vehicle comprising a display device comprising a fault monitoring apparatus.
Figure 1B:
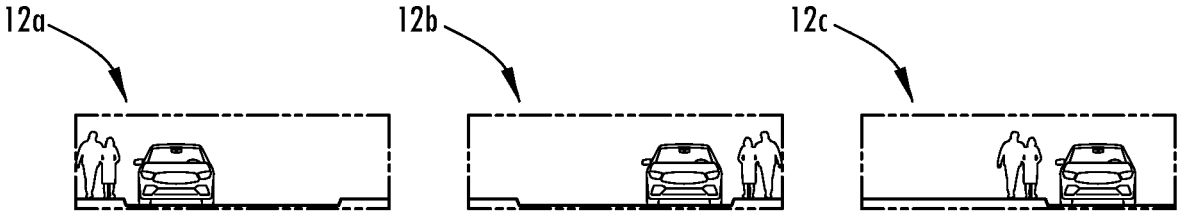
FIG. 1B illustrates front views of the display device demonstrating normal operation as well as error states of the display apparatus in daylight conditions.
Figure 1C:
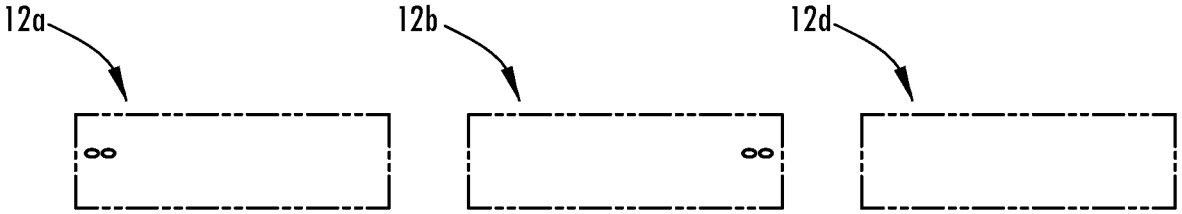
FIG. 1C illustrates front views of the display device demonstrating normal operation as well as error states of the display apparatus in night conditions.

As demonstrated in FIGS. 1B and 1C, examples of normal operation and a variety of error states of the display 12 are shown during daylight conditions in FIG. 1B and night conditions the display in FIG. 1C. As discussed in further detail in the following description, the system 10 may be configured to detect various error conditions of the display 12. For example, the normal or proper operation 12*a*, mirrored or flipped operation 12*b*, an offset or shifted operation 12*c*, and a blank or non-operational condition 12*d*. In normal operation 12*a*, the image data depicted on the display 12 may be centered within the desired portion a field of view of the image data such that the image data is displayed in the orientation and proportions that are assigned by an operator of the vehicle 16. As shown in the flipped operation 12*b*, the image data is flipped horizontally, and in the shifted operation 12*c*, the image data is depicted shifted in a different location than configured in the normal operation 12*a*. In some of these circumstances, the operator of the vehicle 16 may detect the error, but in some cases, particularly in night conditions as shown in FIG. 1C, the errors may not be readily apparent.

In general, the disclosure provides for the implementation of one or more test portions 18 formed by one or more test elements (e.g. test pixels "T") 28 of the display 12. The operation of the test portions 18 may be monitored for display accuracy via one or more sensor elements 20 disposed about a display surface 22 of the display 12. In some embodiments, the test portions 18 may be hidden or disposed behind a mask 24 or shield extending about at least a portion of a perimeter 25 of the display 12. Accordingly, these portions of the display 12 may not be visible by a viewer of the display surface 22 and may not be implemented to display the image data of the local environment captured by the camera 14. However, the operation of the test portions 18 and the display elements 26 forming the display surface may receive control and operation information over a shared drive or communication interface. In some embodiments, the test portions may be disposed in an active portion of the display 12.

As discussed herein, the display 12 may correspond to various forms of display technologies. As shall be apparent from the exemplary embodiments, the system 10 may be implemented with a variety of display technologies that may comprise one or more pixels or arrays of lighting elements configured to be selectively illuminated to emit display data as visible light. Examples of such display technologies may include, but are not limited to, liquid crystal displays (LCDs), which may be backlit or edge lit, organic light-emitting diode (OLED) displays, or other related display technologies. Accordingly, the disclosure may provide for a flexible solution that may be implemented to detect failures or faults in the operation.

The sensor elements 20 may include electrical detection circuits, optical sensors, and/or similar devices that may be operable to detect the activity of one or more of the test elements 28 (e.g. test pixels, circuits, etc.) of the display 12 positioned in the test portions 18. Accordingly, the system 10 may operate by detecting the activity of the test elements 28 in the test portions 18 in order to detect the representative operation of a plurality of display elements 26 (e.g. pixels) extending over the display surface 22 of the display 12. The operation of the test portions 18 may represent the operation of the display elements 26 forming the display 12 as a whole because the test portions 18 may share the same driving circuitry, data connections, and various control variables with the display elements 26 forming the display surface 22. Accordingly, the test portions 18 formed by the test elements 28 (e.g. test pixels, emitters, etc.) may be operable to detect failures of one or more segments or portions of the display 12 as well as detecting orientation errors, display failures, color or radiance inaccuracies and other display failures. Additionally, such detection may be processed and monitored throughout the operation of the display 12.

In various implementations, the system 10 may comprise a controller 30 configured to monitor the operation of the test portions 18 of the display 12. In operation, the controller 30 may be configured to control a test program, which may control a lighting pattern or sequence of the test portions 18. During the operation of the test sequence, the controller 30 may monitor the operation of the test portions 18 based on information captured and communicated from the sensor elements 20. In this way, the controller 30 may be configured to identify whether the test sequence is accurately displayed by the test portions 18.

Figure 4:
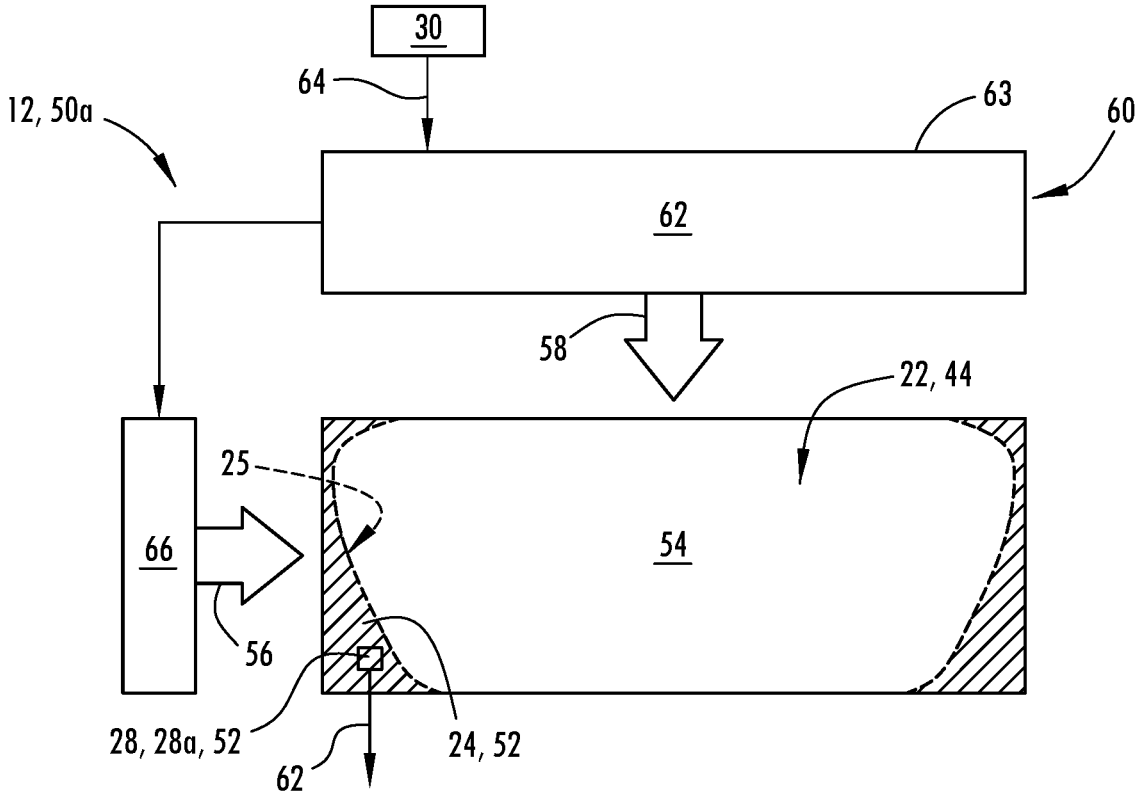
FIG. 4 is a simplified block diagram of a monitoring apparatus for a display device.
Figure 5A:
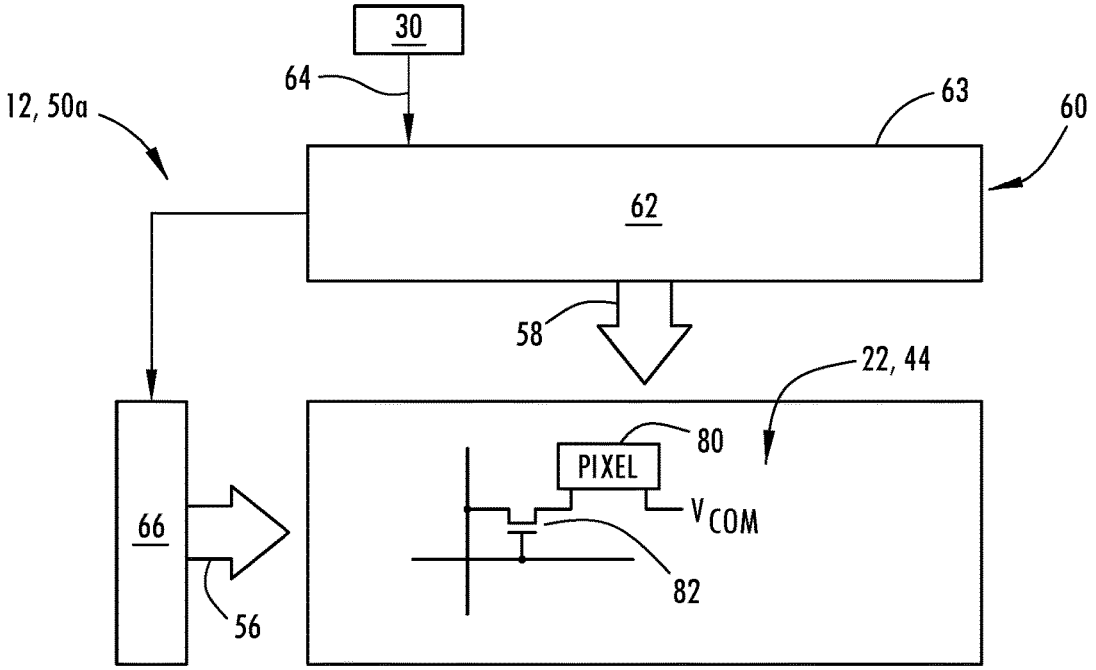
FIG. 5A is a block diagram of a monitoring apparatus as introduced in FIG. 4 demonstrating a representative pixel.
Figure 5B:
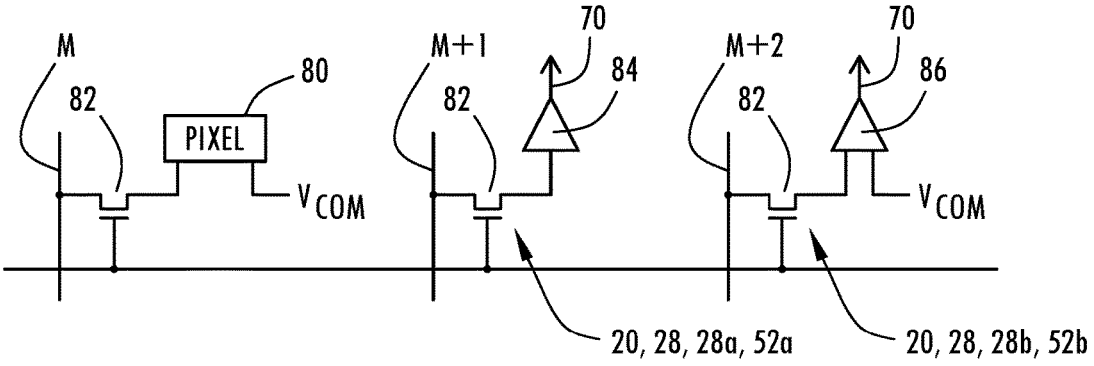
FIG. 5B is a circuit diagram demonstrating a conventional pixel and exemplary test pixels for operation with the monitoring apparatus.

In some implementations, the test portions 18 may comprise non-illuminating or passive test elements 28A that may be configured to detect the operation of the display via an inoperable or non-illuminating test pixel as further discussed in reference to FIGS. 4, 5A, and 5B. The passive test pixels 28A may be configured to detect the delivery of control signals and output a diagnostic signal to the controller 30 to identify the operation. Additionally, the test portions 18 may comprise active or illuminating test elements 28B as further discussed in reference to FIGS. 7-8. The illuminating test elements 28B may be masked or hidden from the remainder of the display elements 26 by the mask 24 forming the test portion 18. Accordingly, the system 10 may provide for the test elements 28 to monitor the operation of the display 12 such that the controller may detect one or more error states.

In each of the examples discussed herein, the operation of the test pixels 28 may provide for real time feedback to the controller 30 such that the controller 30 may monitor an operating state of the display 12. In this configuration, since the test portions 18 are masked or hidden from the remainder of the display elements 26 by the mask 24, the controller 30 may be configured to monitor the operation of the test portions 18 throughout the operation of the display 12 without being detected by a viewer of the display 12. Since the test portions are controlled via the same driving circuitry as the remainder of the display screen, monitoring the operation of the test portions 18 is effective in determining faults in the operation of the display 12 as a whole.

Referring now to FIGS. 3A-3E, examples of the test portions 18 of the display 12 are shown demonstrating at least one of the test elements 28 incorporated in a test region 42 and the plurality of pixels or display elements 26 disposed in the display region 44 of the display surface 22. In the example, the test portions 18 may be hidden or disposed behind the mask 24 or shield extending about at least a portion of a perimeter 25 of the display 12. In general, the test elements 28 may be disposed about the perimeter 25 of the display 12. Accordingly, in various implementations, the mask 24 or shield may be formed as a portion of a housing or trim panel configured to house and/or support the display 12 mounted in various portions of the vehicle 16.

Figure 3A:
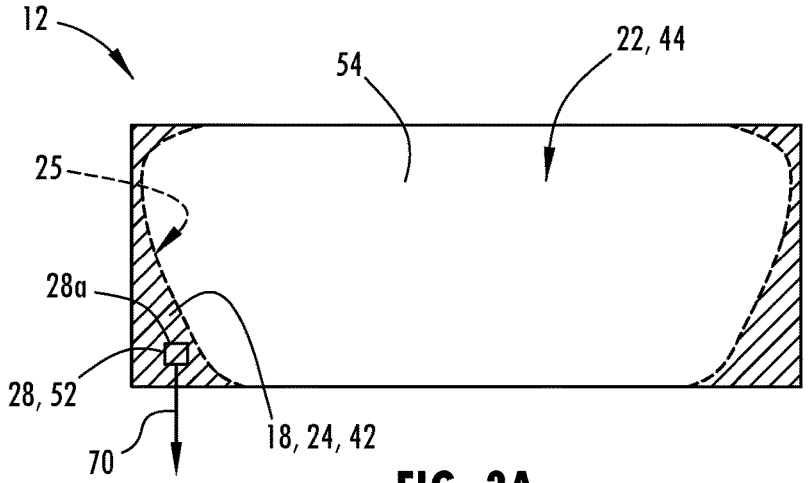
FIG. 3A is a schematic diagram demonstrating a test region and a display region of a pixel array.
Figure 3B:
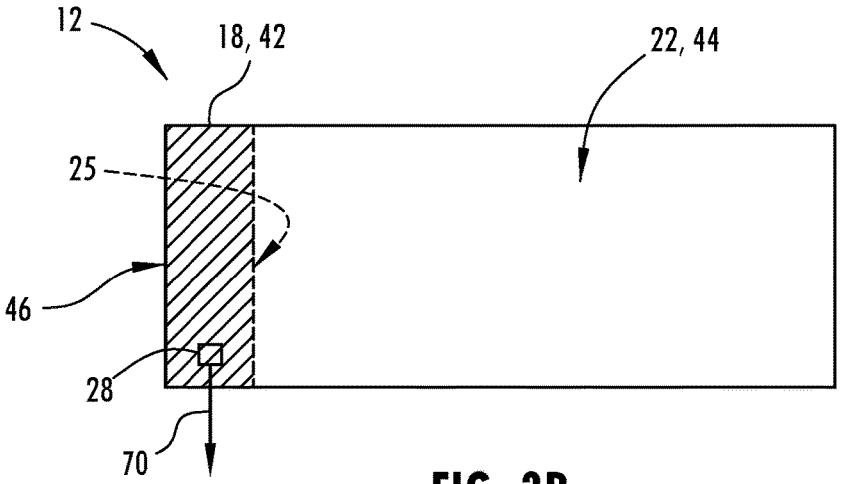
FIG. 3B is a schematic diagram demonstrating a test region and a display region of a pixel array.

As demonstrated in FIG. 3A, the test region 42 may extend along one or more edges of the perimeter 25 of the display 12. Similarly, the test region 42 may extend over one or more corners 46 or edge portions extending over or cropping portions of the display surface 22 as shown in FIG. 3B. As previously discussed, the illuminating test elements 28B may be implemented in the test regions 42 and may be shielded from display surface 22 of the display 12 by the mask 24, such that the operation of the test elements 28 does not distract a viewer from the display of the operation of the display elements 26 forming the display region 44. Accordingly, in this configuration, the test elements 28 may be controlled to operate and diagnose the operation of the display 12 throughout operation without impeding or interrupting operation of the display elements 26 displaying video and/or image data on the display region 44.

Figure 3C:
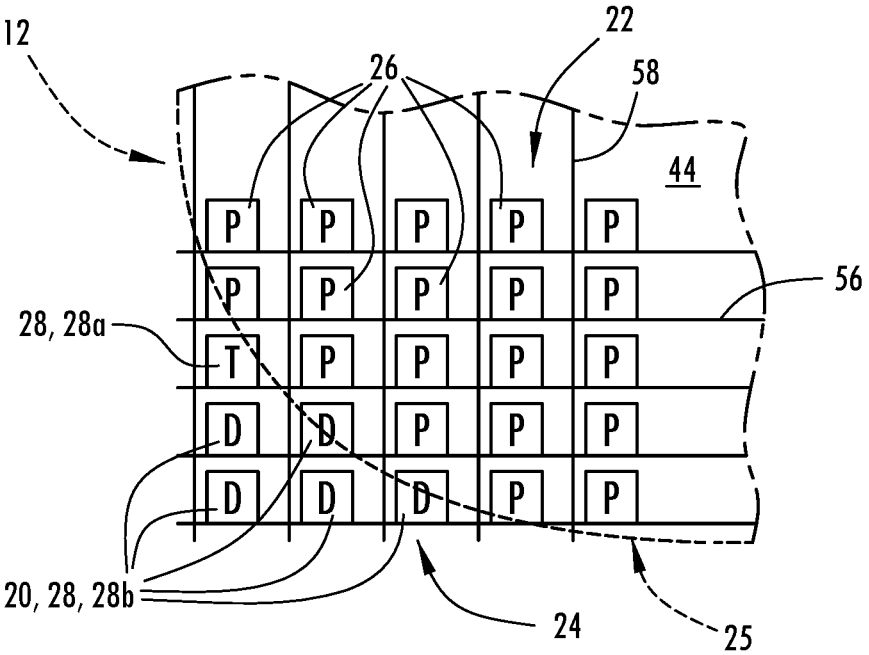
FIG. 3C is a detailed diagram of a portion of a display screen of the display demonstrating the test elements of the system disposed along a contoured perimeter edge.
Figure 3D:
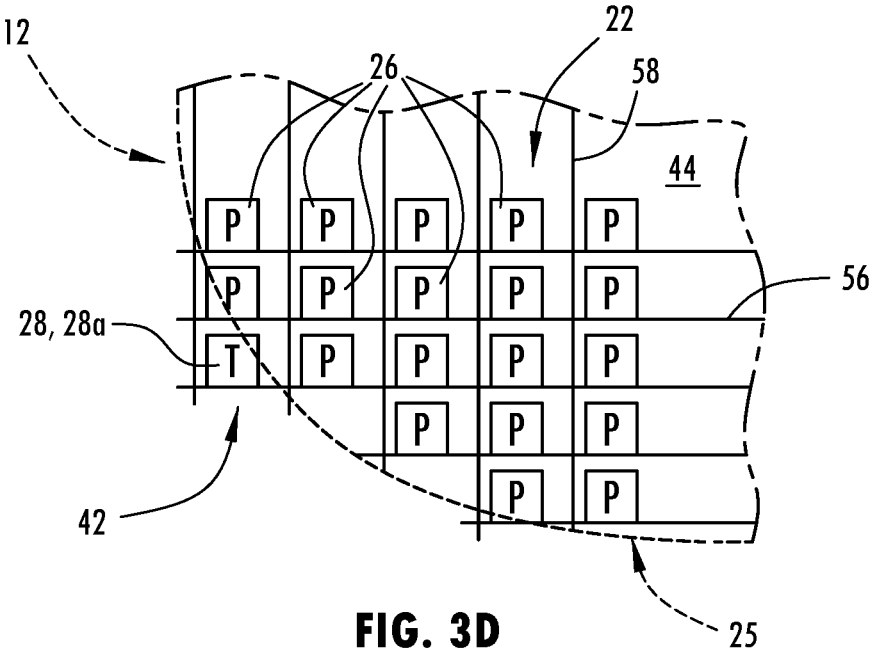
FIG. 3D is a detailed diagram of a portion of a display screen of the display demonstrating the test elements of the system disposed along a contoured perimeter edge.
Figure 3E:
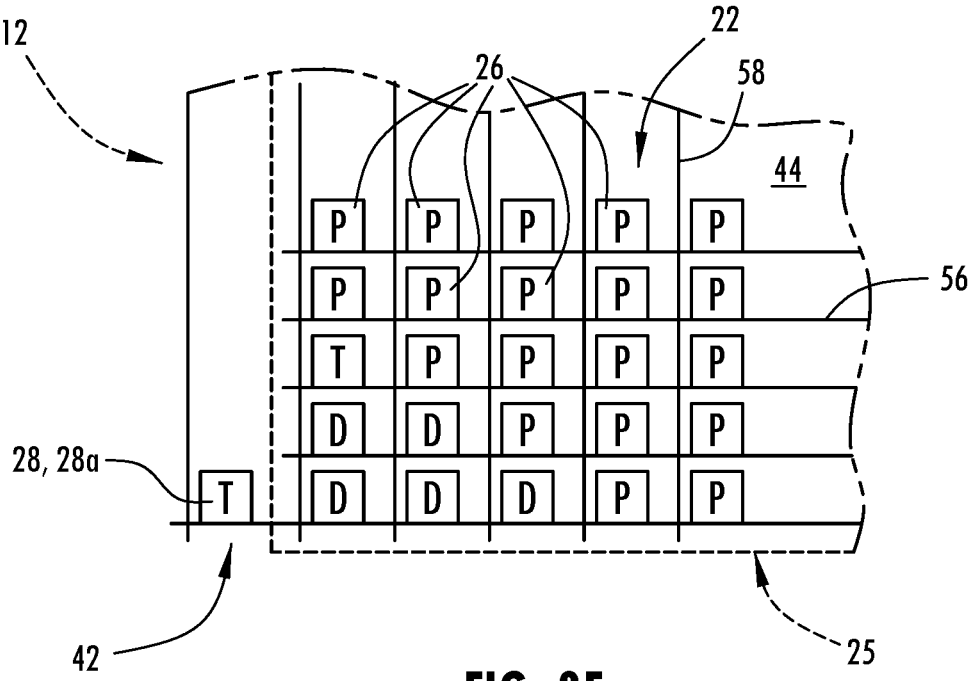
FIG. 3E is a detailed diagram of a portion of a display screen of the display demonstrating the test elements of the system disposed along a rectangular perimeter edge.

Referring now to FIGS. 3C, 3D and 3E, examples of the passive test elements 28A and the illuminating test elements 28B are shown. As annotated in FIGS. 3C and 3D, the passive test elements 28A may be referred to as electrical test elements or test pixels as further discussed in reference to FIGS. 4, 5A, and 5B. Additionally, the illuminating test elements 28B may be referred to as dummy pixels or optical test elements as further discussed in reference to FIGS. 7-8. In the exemplary configurations, the test elements 28 may be implemented alone or in combination and may be distributed along the perimeter 25 of the display surface 22. In some cases, the passive or electrical test elements 28A may also or alternatively disposed within interstices or spaces formed among or within the display elements 26.

Referring now to FIGS. 2, 4, 5A, and 5B, an exemplary implementation of the display 12 is shown comprising a first monitoring apparatus 50A (FIG. 4). The first monitoring apparatus 50A may comprise a plurality of the test elements 28. As previously discussed, test element 28 may correspond to a passive or non-illuminating test element 28, which may be in the form of one or more test pixels 52. Each of the test pixels 52 may form a portion of a pixel array 54 forming the display surface 22. The pixel array 54 may comprise a plurality of columns and rows with corresponding gate lines 56 and source lines 58 forming N rows and M columns (e.g., N×M matrix). The sensor elements 20 or in this case the test pixels 52 may form a portion of the pixels forming the pixel array 54. In this configuration, the first monitoring apparatus 50A may be configured to detect the operation of the test pixels 52 in coordination with the operation of the pixel array 54.

As depicted in FIG. 4, the display 12 may comprise a driver control circuit or driver circuit 60 comprising a source driver 62 and a timing controller TCON. The driver circuit 60 may be configured to receive a video input 64 and output control signals for the source lines 58 as well as control signals for a gate driver 66 configured to control the gate lines 56. In this configuration, the control circuit 60 may be configured to control the activation of each of the pixels forming the pixel array 54 via the gate lines 56 and the source lines 58. In operation, the driver circuit 60 is in communication with the pixel array 54 via the gate lines 56 and the source lines 58 designating the proportions of the pixel array 54 at least a portion of which forms the display surface 22. Though the pixel array 54 is logically designated to include N rows and M columns of pixels, the display region 44 of the display surface 22 may only extend over a portion of the pixel array 54, and the test elements 28 or test pixels 52 may be incorporated in the test region 42 shielded or hidden behind the mask 24.

In some implementations, the mask 24 of the display 12 may cover portions of one or more of the rows or columns forming the pixel array 54. For example, the display 12 may be implemented as a rearview display device, which may comprise a bezel enclosing a portion of the display surface 22. In such examples, the bezel, or more generically the mask 24, may extend over a portion of one or more of the rows and columns extending about the perimeter 25 of the pixel array 54.

In operation, the video input 64 indicates the control signals sent to the pixel array 52 and the test pixels 54 via the gate lines 56 and source lines 58. The video input may be received in the form of a video stream sent from a display driver. Since the test pixels 52 are positioned behind the mask 24 in the test region 42, the control information for their operation may be intended for testing as opposed to the visual input information communicated by the remaining display elements 26 positioned in the display region 44. As further discussed in reference to FIG. 5, the test pixels 52 may not be configured to output visible light or provide any appreciable form of optical output. Instead, the test pixels 52 may be configured to receive the control signals from the source lines 58 and gate lines 56 and generate one or more diagnostic signals 70 configured to provide operating information identifying the operation of the test pixels 52. As test pixels 52 operate in response to the same control signals and the same video input 64, their operation is representative of the display elements 26 forming the display region 44.

Referring now to FIGS. 4, 5A, and 5B, schematic representations of the display elements 26 and the test pixels 52 are shown. As demonstrated in FIG. 5A, the schematic of the display 12 demonstrates a representation of the display elements 26 as a pixel 80 forming a portion of the display region 44 of the display surface 22. The pixel 80 may comprise a transistor 82 in connection with a first gate line N and a first source line M. The transistor 82 is in connection with the pixel 80, which is further connected to a common voltage Vcom. This configuration may be repeated throughout the pixel array 54 to form the display region 44. Each of the test pixels 80 may be arranged in connection with the rows and columns of the gate driver 66 and the source driver 62. Though discussed in reference to the pixels 80, each of the pixels 80 or display elements 26 as discussed herein may similarly be implemented as one or more sub pixels or portion forming light emitting elements of the display 12, which may be configured to emit one or more colors of light in order to support a variety of forms of display technologies.

Referring now to FIG. 5B, schematic examples of a first test pixel 52*a* and a second exemplary pixel 52*b* are shown in connection with the gate line N, a second source line M+1, and a third source line M+2. As the first test pixel 52*a* and the second test pixel 52*b* are connected to the same gate lines 56 and source lines 58 as the pixels 80 or display elements 26 forming the display region 44, the test pixels 52*a*, 52*b* may respond similarly and provide diagnostic information identifying the operation of the display elements 26. The first test pixel 52*a* may be configured to output the diagnostic signal 70 in the form of a pixel voltage supplied from the connected transistor 82 and communicated via a first amplifier 84. Similarly, in a slightly more complex topography, the second test pixel 52*b* may be configured to communicate a difference voltage identified via a second amplifier 86 (e.g., a difference amplifier). In this configuration, the second amplifier 86 may output the diagnostic signal 70 as a voltage potential difference between an output from the connected transistor 82 and the common voltage Vcom.

The diagnostic signals 70 identified by the test pixels 52*a*, 52*b* provide meaningful feedback to the display driver or controller 30 that may identify the operation of various portions of the pixel array 54 and may also provide feedback regarding the related operations from one region or side of the pixel array 54 to another. For example, the diagnostic signals 70 may indicate whether or not one or more portions of the pixel array 54 are operational based on the representative operation and corresponding diagnostic signals 70 generated by the test pixels 52 in response to the video input 64. Accordingly, the controller 30 may process the diagnostic signals 70 to detect a failure of the display 12. Display failures may include, for example, image data mirrored across the display surface 22, a frozen state of the display 12, or various other failure states. Specific examples of failure states and their corresponding diagnosis via the test pixels 52 is further discussed in reference to FIGS. 6A, 6B, and 6C.

Figure 6A:
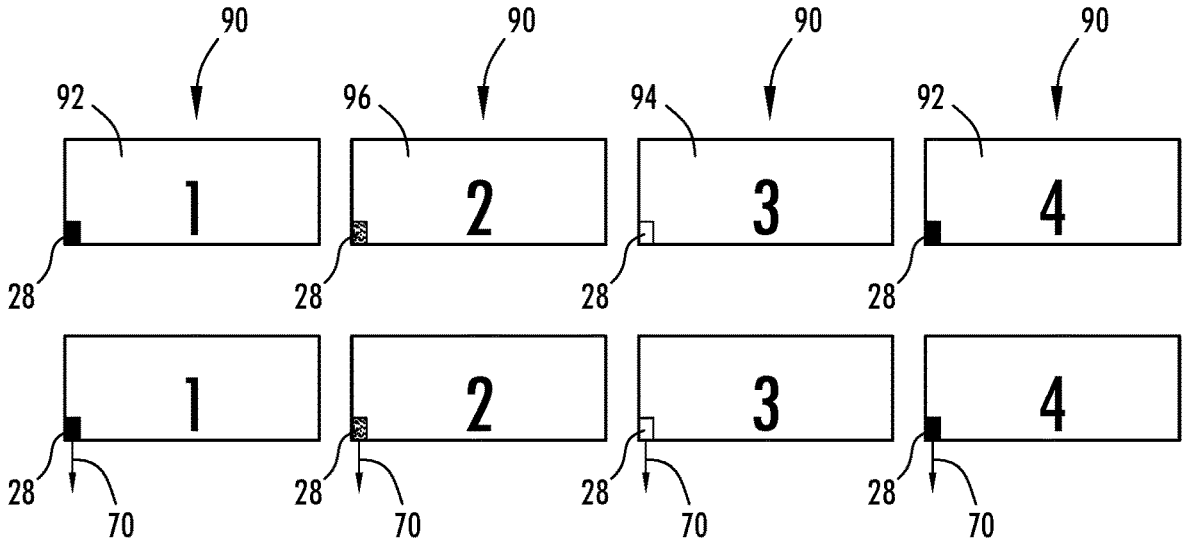
FIG. 6A illustrates a response of the monitoring apparatus to a test pattern.
Figure 6B:
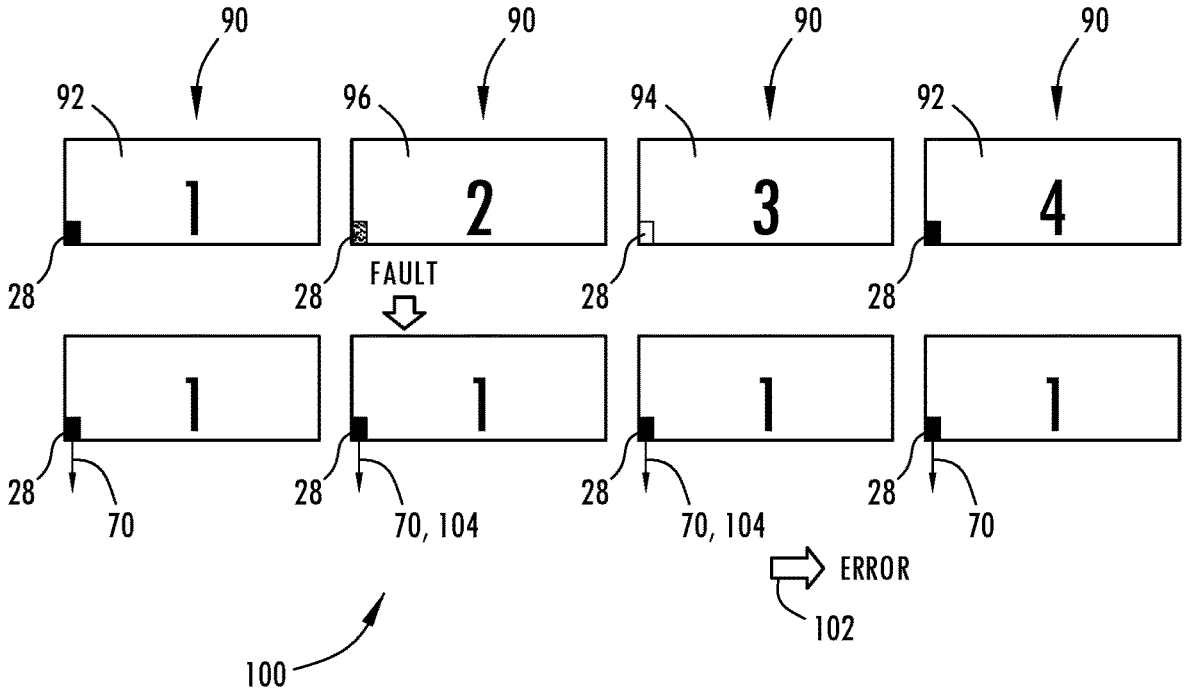
FIG. 6B illustrates a response of the monitoring apparatus to a test pattern.
Figure 6C:
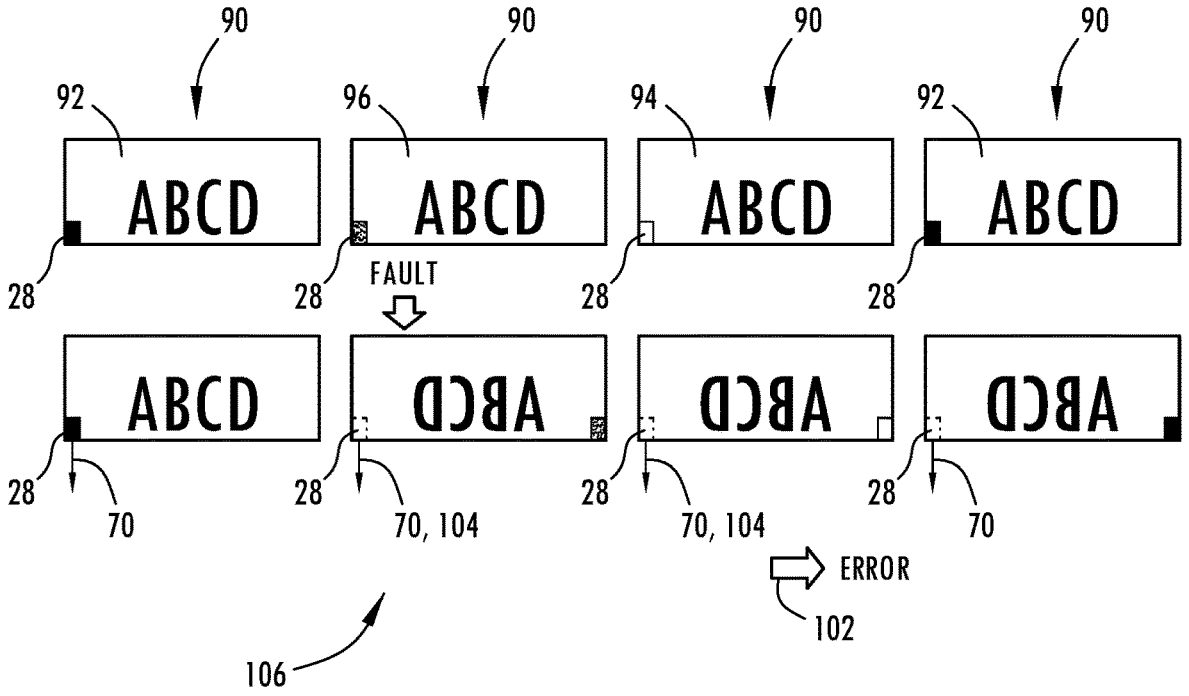
FIG. 6C illustrates a response of the monitoring apparatus to a test pattern.

Referring now to FIGS. 6A, 6B, and 6C; the operation of the test elements 28 (e.g. the passive test element 28A and/or the illuminating test elements 28B) is discussed in reference to one or more test patterns received via the video input 64. As demonstrated in FIG. 6A, a test pattern 90 may be supplied to the test element 28 in order to test an inactive state 92, fully active state 94, and intermediate state 96 of the test element 28. The inactive state 92 corresponds to a darkened or black pixel, the fully active state 94 may correspond to a white or brightly activated pixel, and the intermediate state 96 may corresponds to a grayscale or intermediate color intensity of the test element 28. As demonstrated in response to the first test pattern 90, the diagnostic signal 70 identifies whether the pixel is off in the inactive state 92, fully on in the fully active state 94, or partially active in the intermediate state 96. The magnitude of the diagnostic signal 70 (e.g. pixel check signal) indicates the corresponding voltage and activation intensity of the test element 28. In this way, the controller 30 may monitor the diagnostic signal 70 throughout the operation of the display 12 to verify the operational integrity of the display 12. Though introduced in reference to FIG. 6A, each of the states 92, 94, and 96 controlled via the test pattern is also applicable to the timing sequences discussed in reference to FIGS. 6B and 6C.

As demonstrated in FIG. 6A, the operation identified in the diagnostic signal 70 indicates that the test element 28 is operating normally without an indication of a fault or failure in the display 12. In FIG. 6B, the same test pattern 90 is supplied via the video input 64 or control signal supplied by the controller 30. Referring now to FIG. 6B, the image data represented on the display may correspond to an example of a refresh failure event. A refresh failure event 100 of the display 12 may be identified by the test element 28. As demonstrated, the test element 28 may initially respond appropriately to the control signal in the first frame. However, following one or more different signals identified by the test element 28 that do not correspond to the test pattern 90, the controller 30 may identify an error or fault condition 102 for the display 12. As demonstrated in FIG. 6B, the controller 30 may identify the refresh failure event following multiple consecutive failure indications 104 communicated via the diagnostic signal 70. In the example shown, the controller 30 is configured to identify the refresh failure event or fault condition 102 in response to two consecutive failure indications 104 as demonstrated in the second frame and the third frame. In this way, the controller 30 may diagnose the refresh failure event with a debounce or delay requiring a plurality of failure indications 104 prior to the identification of the fault condition 102. Following the identification of the fault condition 102, the controller 30 may deactivate the display 12 by controlling a backlight to an off condition.

Referring now to FIG. 6C, the controller 30 may similarly monitor the operation of the test element 28 to a mirrored condition 106 of the video or image data supplied to the pixel array 54 of the display 12. For example, the controller 30 may monitor the diagnostic signal 70 in order to identify the fault condition 102 resulting from the mirrored image data. As shown in FIG. 6C, the first frame may be accurately communicated to the test element 28 and communicated to the controller 30. However, in the second frame, the control signal associated with the test pattern 90 (e.g. the intermediate state 96) is not communicated to the test pixel 28. Similarly, the control information associated with the video input 64 is not communicated to the test element 28 in the third frame or the fourth frame of the test pattern 90. Accordingly, the diagnostic signal 70 may communicate one or more failure indications 104 for each of the second frame, the third frame, and the fourth frame. Accordingly, the failure indications 104 for the mirrored condition 106 may result from the control data being communicated to the test element 28 differing from the test pattern 90. In response to any one of the failure indications 104, the controller may identify the fault condition 102 resulting from the mirrored image data communicated to the display 12. Accordingly, the operation of the system 10 may provide for effective feedback to identify a variety of failure conditions of the display 12.

As demonstrated in FIGS. 6A, 6B, and 6C, the controller 30 may monitor the diagnostic signal 70 from the test elements 28 to ensure that the control information communicated to the pixel array 54 from the controller 30 via the video input 64 is accurately executed by the display 12. For example, if the control state (e.g. states 92, 94, or 96) of the test element 28 as identified via the diagnostic signal 70 differs from the instruction in the video input, the controller 30 may identify the failure indication 104. Once one or more of the failure indications 104 are detected by the controller 30, the controller 30 may determine that the display is operating incorrectly or malfunctioning in the fault condition 102. In response to the detection of the fault condition 102, the controller 30 may deactivate the display 12, display or announce a via an additional vehicle notification device (e.g., a dashboard display, infotainment system, etc.), and/or activate a conventional mirror mode of the display 12. For additional information regarding examples of image or video displays with mirror functionality, reference is made to U.S. Pat. No. 10,018,843 entitled "Display Mirror Assembly" and U.S. Pat. No. 10,189,408 entitled "Display Mirror Assembly Incorporating Heatsink," the disclosure of each of above-mentioned patent documents is incorporated herein by reference in its entirety.

Figure 7:
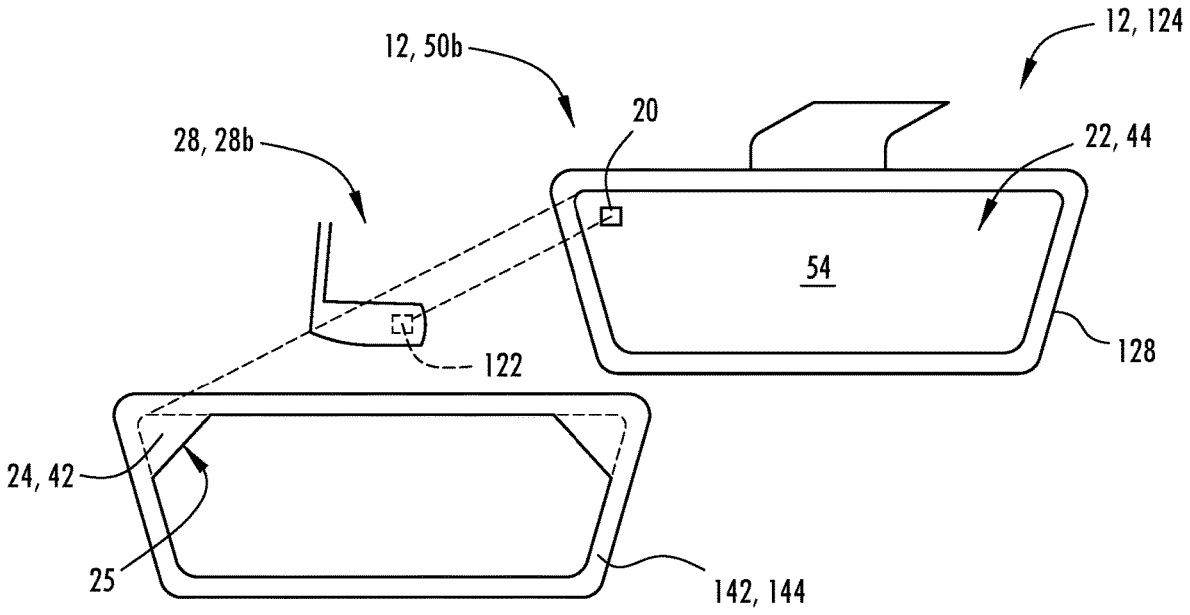
FIG. 7 is an exploded view of a display device having a monitoring apparatus.
Figure 8:
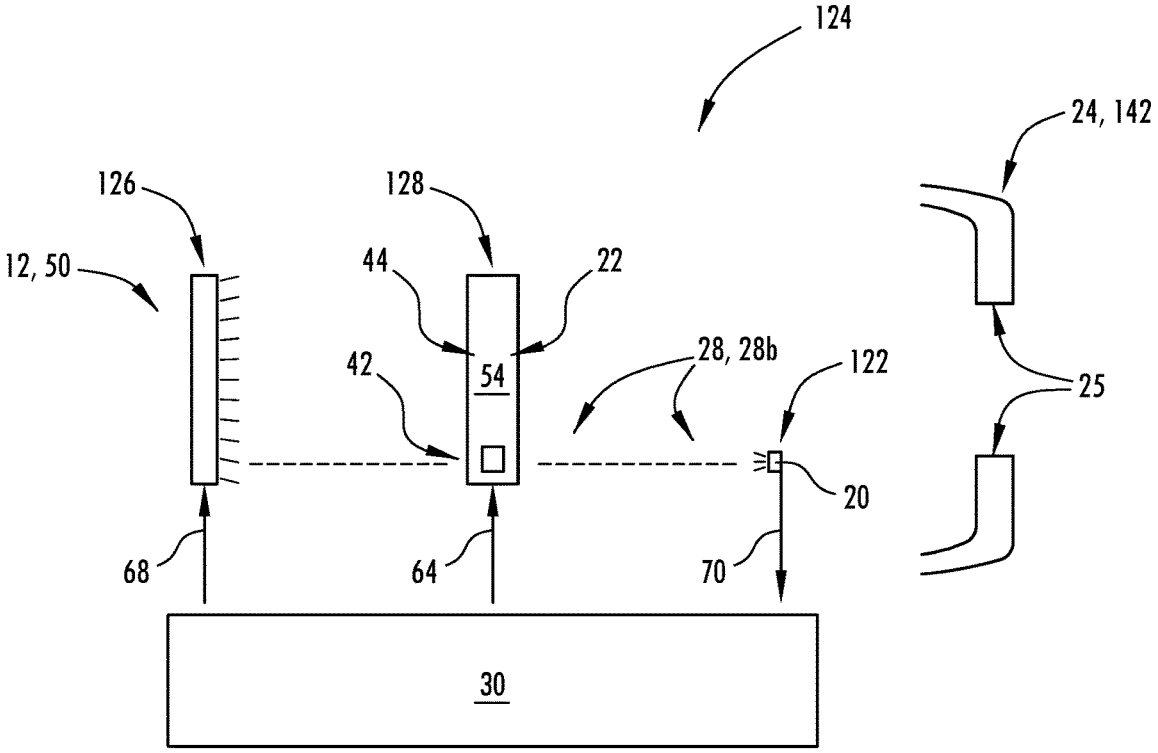
FIG. 8 is a cross-sectional view of the monitoring apparatus illustrated in FIG. 7.

Referring now to FIGS. 7 and 8, an exemplary embodiment of a second monitoring apparatus 50B of the display 12 is shown. The second monitoring apparatus 50B may comprise the sensor elements 20 in the form of an optical or light sensor 122 as shown. FIG. 7 demonstrates an exploded view of an assembly 124 of the display 12, and FIG. 8 demonstrates a cross-sectional schematic diagram of the assembly 124 shown in FIG. 7. As previously discussed, the system 10 may be implemented utilizing the passive test elements 28A that may be configured to detect the operation of the display via the non-illuminating test pixels 52. Additionally, as discussed in reference to FIGS. 7 and 8, the system 10 may be implemented utilizing the illuminating test elements 28B, which may be hidden from the remainder of the display elements 26 by the mask 24. In this configuration, the sensor elements 20 may be implemented as the light sensors 122. Additionally, the displays 12 discussed in reference to FIGS. 4 and 8 may share a variety of like components, which may be described utilizing like reference numerals for clarity. Accordingly, while there may be differences in the exemplary devices disclosed herein, the subject matter of the exemplary implementations may be used in various combinations without departing from the spirit of the disclosure.

In the examples depicted in FIGS. 7 and 8, the test portions 18 are formed by the pixels 80 of the display 12 in combination with the light sensors 122, which may form the optical test elements 28B. The operation of the test portions 18 may be monitored for display accuracy in response to a test pattern via one or more sensor elements 20 in the form of the light sensors 122. As discussed in reference to the test pixels 52, the test portions 18 of display elements 26 monitored by the light sensors 122 may be hidden or disposed behind a mask 24 or shield extending about at least a portion of a perimeter 25 of the display 12. Accordingly, these portions of the display 12 may not be visible by a viewer of the display surface 22. In this configuration, the controller may be configured to receive the diagnostic signals 70 from the light sensors 122 in order to monitor the operation of pixels 80 located in the test regions 42. As previously discussed herein, the operation of the pixels 80 or display elements 26 located in the test regions 42 may be monitored by the controller 30 in order to infer and diagnose various operating conditions of the pixel array 54 forming the display 12.

In operation, the second monitoring apparatus 50B may be configured to detect the operation of one or more of the pixels 80, which may be positioned along a perimeter 25 of the display surface 22. As previously discussed, the display elements 26 of the display 12 may be controlled in response to a video input 64 supplied to a driver circuit 60. The driver circuit 60 may comprise the source driver 62 and a timing controller TCON. In response to the video input, the driver circuit 60 may output control signals for the source lines 58 as well as control signals for the gate driver 66 configured to control the gate lines 56. In this configuration, the control circuit 60 may be configured to control the activation of each of the pixels 80 forming the pixel array 54 via the gate lines 56 and the source lines 58. Additionally, the controller 30 may be configured to selectively activate a backlight 126 via a backlight control signal 68.

In order to detect the operation of the one or more pixels 80 in the test region 42, the controller 30 may activate the backlight 126 to emit light into a liquid crystal display (LCD) panel 128. The gate lines and source lines 56, 58 may selectively allow the light from the backlight 126 to pass through the LCD panel 128. The light output from the LCD panel 128 may be detected by the light sensor 122, and the light sensor 122 may generate and communicate the diagnostic signals 70 to the controller 30. As previously discussed, the light emitted from the LCD panel 122 and the corresponding display elements 26 of the display 12 may be shielded by the mask 24 which may be implemented as a bezel extending around at least a portion of the perimeter 25 of the display surface 22. In this configuration, the illuminating or optical test elements 28B may comprise light sensors 122 disposed about one or more locations proximate the perimeter 25 of the display surface 22. Accordingly, the light sensors 122 may detect the operation and relative intensity of the display elements 26 or pixels 80 in at least the inactive state 92, the fully active state 94, and the partially active or intermediate state 96. Though only one intermediate state is specifically described, it may be understood that the resolution and accuracy of the states identified by the sensor elements 20 may widely vary based on the sensitivity of the light sensors 122, the test pixels 52 and corresponding amplifiers 84, 86, and the sophistication (accuracy or resolution) of the input circuits of the controller 30 configured to receive the diagnostic signals 70.

In some implementations, the light sensor 122 may be mounted to a portion of the display 12 (e.g., the display surface 22), which may be disguised or otherwise concealed from view by the mask 24. In some examples, the light sensor 122 may be mounted such that a photoreceptor faces the display surface 22. However, the light sensor 122 may also be implemented in different locations or portions of the display 12 by utilizing a light pipe or optical fiber to communicate the light energy emitted from the pixels 80 disposed in the test region 42. In this configuration, the one or more light sensors 122 may communicate the diagnostic signals 70 to the controller 30 in various arrangements. Additionally, the resulting diagnostic signals 70 operate similarly to those discussed in reference to the test pixels 52 discussed previously in reference to FIGS. 6A, 6B, and 6C.

Figure 9:
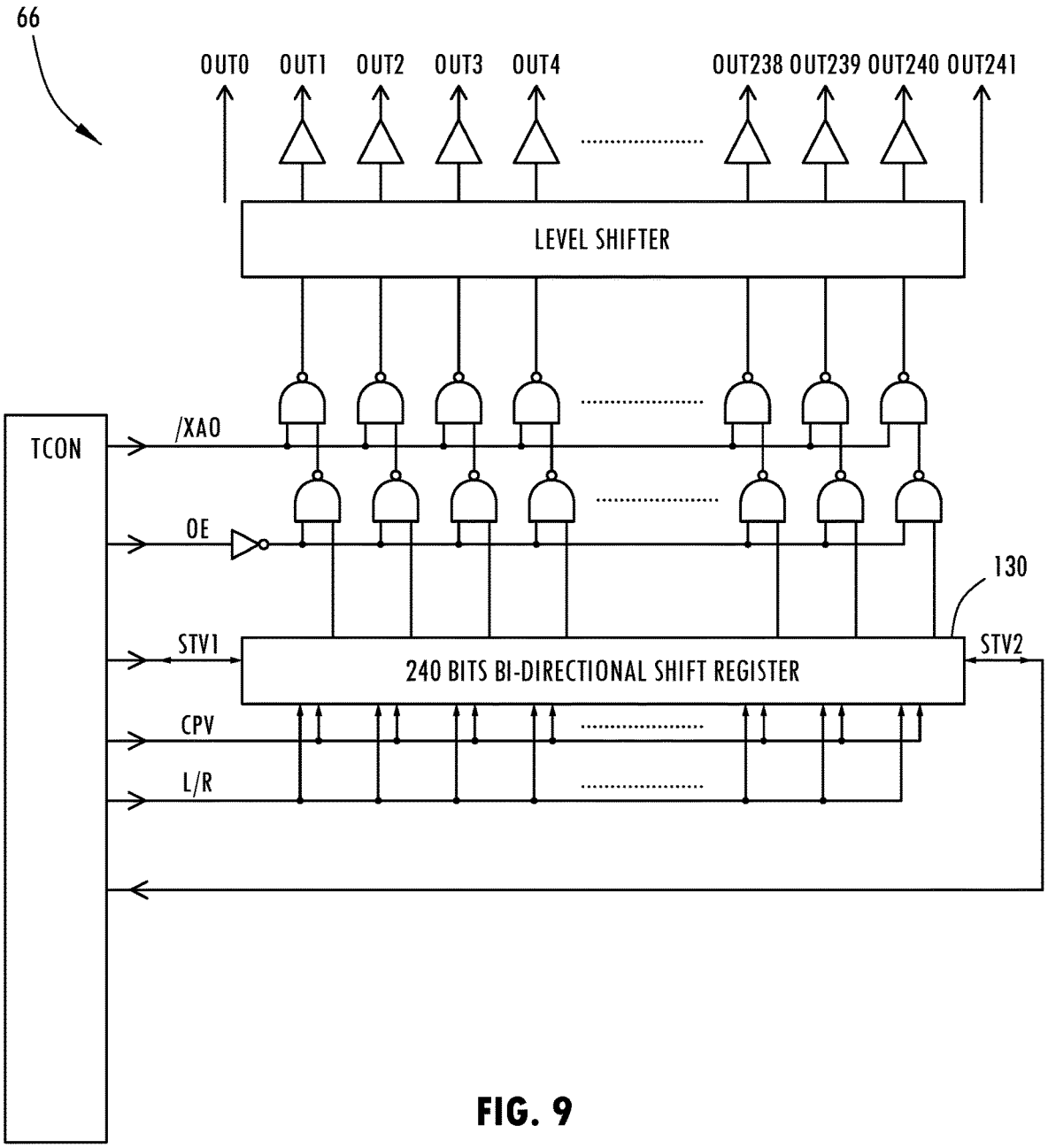
FIG. 9 is a simplified schematic diagram of the gate driver for a display device.

Referring now to FIG. 9, the system 10 may further be configured to monitor the operation of the pixel array 54 via the gate driver 66. As depicted in FIG. 9, a simplified schematic diagram of the gate driver 66 is shown. In operation, the gate driver 66 may be configured to selectively activate the rows of the pixels 80 forming the pixel array 54. However, if there is a broken connection or other issue related to the operation of the gate driver 66, such failures may be challenging to detect without test elements 28 or sensor elements 20 as discussed herein. Additionally, the display 12 may be susceptible to failures related to the gate driver 66 due to the proportions and delicate nature of the conductive connections connecting the gate driver 66 to the gate conductors or traces, shown at 154 in FIG. 10B.

In an exemplary operation, the timing controller TCON controls the inputs supplied to the gate driver 66. In this configuration, the elements forming the gate driver 66 may typically be a bidirectional shift register 130 configured to receive a clock input CPV to control or shift the data in a direction identified via the shift direction L/R. There are two start vertical signals STV1 and STV2. Additional control signals output from the timing controller TCON may include the output enable control OE, which may be used control a channel output, and an output all high signal /XAO that may be configured to force each of the output pins (e.g. OUT0, OUT1, OUT2, . . . OUT241) to a high level.

The first start vertical signal STV1 is an input and the second start vertical signal STV2 is an output from the bidirectional shift register 130. The output or in this case, the second start vertical signal STV2 may be supplied as an input to the input timing controller TCON. In operation, the timing controller TCON may be configured to monitor the second start vertical signal STV2 from the bidirectional shift register 130. For example, the timing controller TCON may monitor the signal to determine if a start pulse STV is returned from the gate driver 66 as well as a corresponding expected number of clocks. If the start pulse STV or the expected number of clocks are not received by the timing controller TCON, the timing controller TCON may identify that there is a problem with the operation of the display 12. In response to such an identification, the timing controller TCON may communicate the operation error to the controller 30, such that the display 12 may be deactivated or an error message may be displayed on the pixel array 54.

Figure 10A:
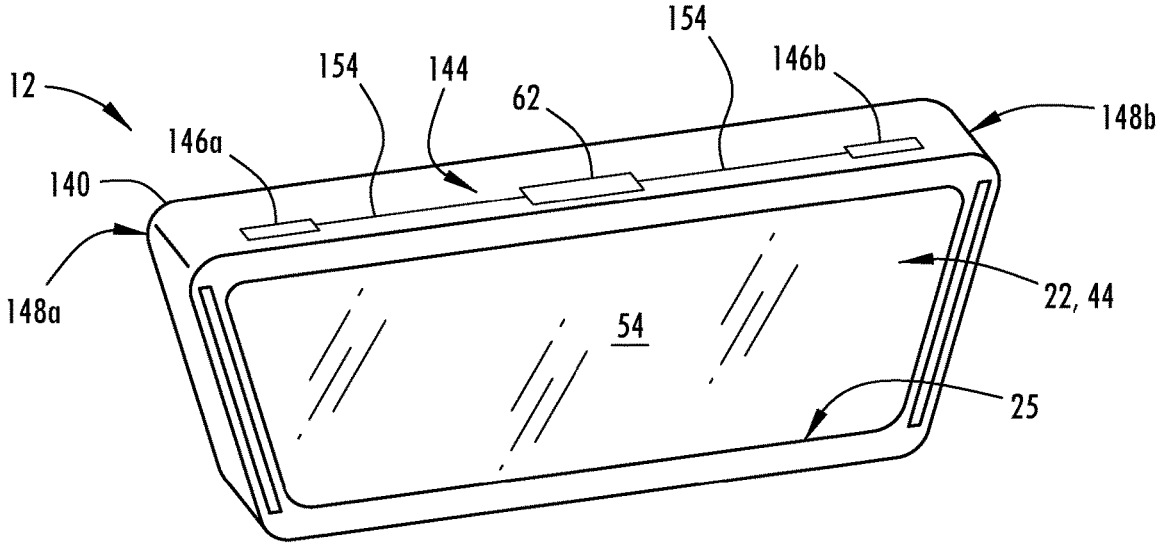
FIG. 10A is a simplified front projected view of a display device demonstrating a gate driver arrangement.
Figure 10B:
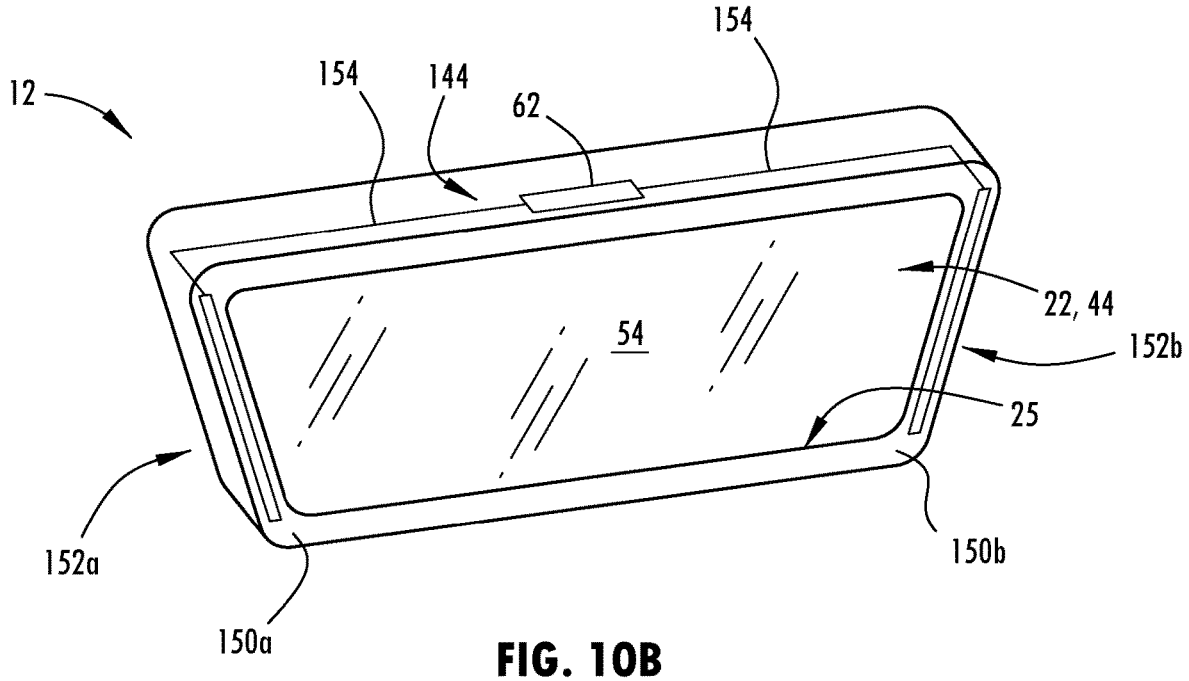
FIG. 10B is a simplified front projected view of a display device demonstrating a gate driver arrangement.

Referring now to FIGS. 10A and 10B, examples of the display disposed in a housing 140, which may comprise a bezel 142 as discussed herein, are shown. The display surface 22 may be enclosed or surrounded by the bezel 142, which as discussed in reference to various examples herein, may correspond to the mask 24 or shield. The timing controller TCON and the source driver 62 may be disposed centrally in a perimeter portion 144 of the housing 140 extending along the perimeter 25 of the pixel array 54. In the example of FIG. 10A, an amorphous silicon (a-Si) LCD is depicted comprising a first gate driver 146*a* and a second gate driver 146*b*. The first gate driver 146*a* may be disposed proximate a first corner 148*a* of the display surface 22, and the second gate driver 146*b* may be disposed proximate a second corner 148*b*, which may be on an opposing side of the display surface 22.

In the example of FIG. 10B, a Low Temperature Poly-Silicon (LTPS) LCD is depicted comprising a first gate driver circuit 150*a* and a second gate driver circuit 150*b*. The first gate driver circuit 150*a* may extend along the perimeter 25 of the pixel array 54 along a first side portion 152*a* and the second gate driver circuit 150B may extend along the perimeter 25 of the pixel array 54 along a second side portion 152*b*. Accordingly, the system may be implemented with a variety of display technologies without departing from the spirit of the disclosure. In each of the examples, the timing controller TCON and the source driver 62 may be in communication with the gate driver circuits 146*a*, 146*b*, 150*a*, 150*b* via conductive traces 154, which may be configured to communicate the control signals to each of the gate driver circuits 146*a*, 146*b*, 150*a*, 150*b*.

Referring now to FIGS. 11A, 11B, 11C, and 11D, the controller 30 may further be configured to display a health indicator 160 and/or one or more warning messages 162. The health indicator 160 may comprise a similar icon that indicates that the system 10 is working normally. As depicted, the health indicator 160 may be depicted on the display 12 to provide a visual indication that may be selectively displayed when the system 10 is operating properly. In this way, the system 10 may provide a visual representation to a user via of the health indicator 160 communicating the operating status of the system 10.

Figure 11A:
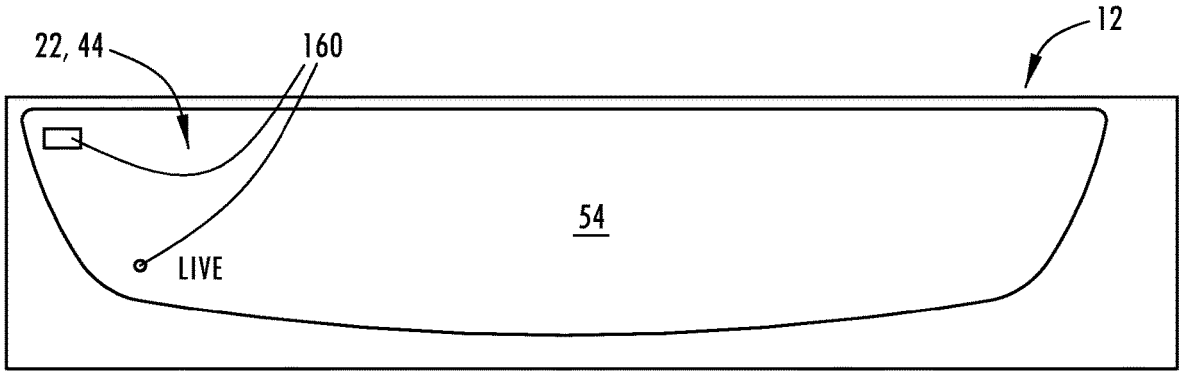
FIG. 11A is a front perspective view of a display device demonstrating a health indicator.
Figure 11B:
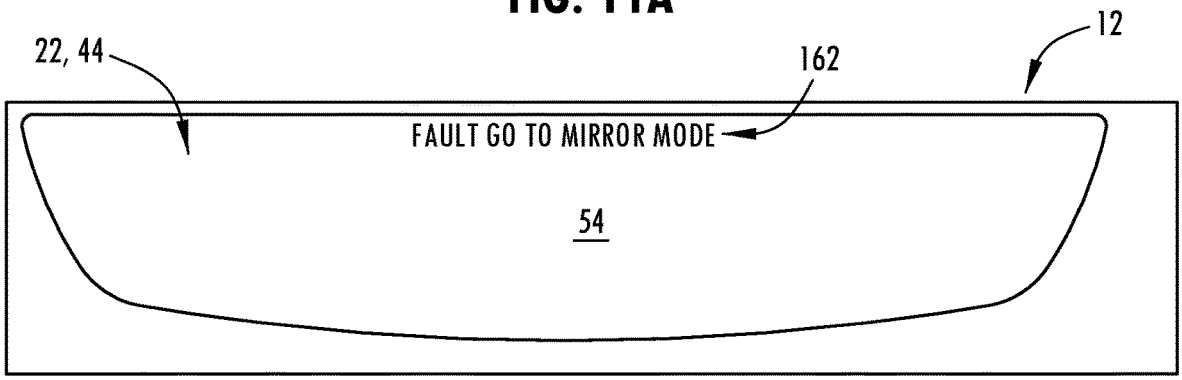
FIG. 11B is a front perspective view of a display device demonstrating a warning notification.
Figure 11C:
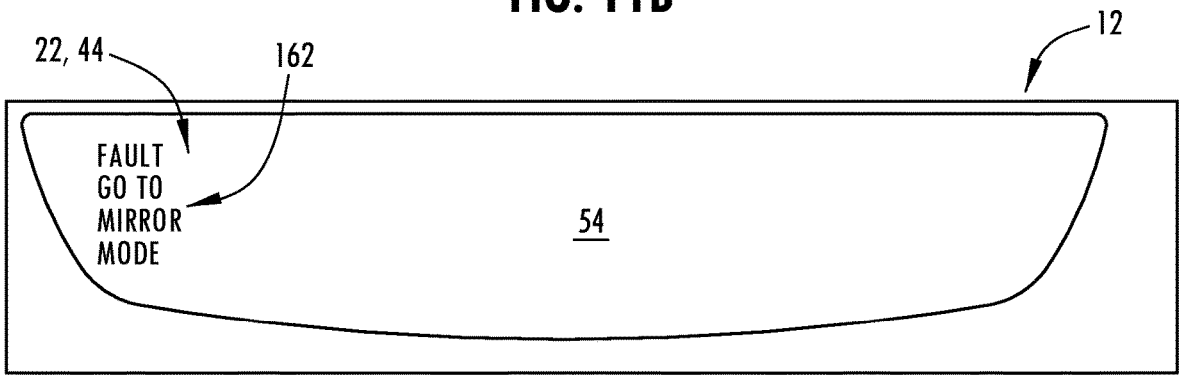
FIG. 11C is a front perspective view of a display device demonstrating a warning notification.
Figure 11D:
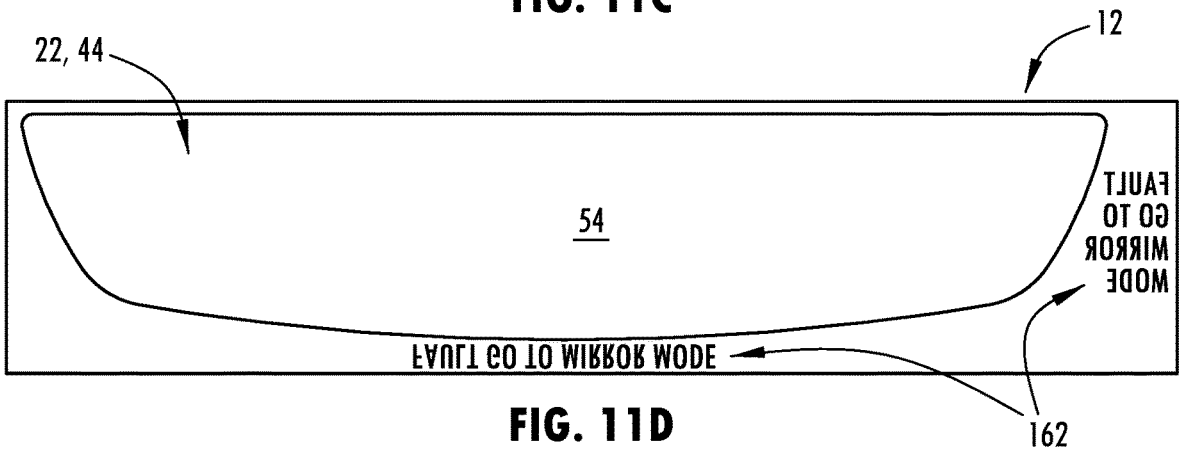
FIG. 11D is a front perspective view of a display device demonstrating a warning notification in accordance with the disclosure.

FIGS. 11B and 11C illustrate warning messages appearing in the display region 44 of the display 12. As depicted in FIG. 11D, the one or more warning messages may be located in portions of the addressable locations of the pixel array 54, such that they are not visible in the display region 44 when the display 12 is operating properly. For example, if the row and column dimensions of the display region 44 are approximately 50 and 250, the warning messages 162 may be displayed beginning with row 60 and 252. In this way, the messages would only appear in the display region 44 if the image data was mirrored or otherwise displayed in error. As depicted in FIG. 11C, the warning message 162 may identify that there is a fault in operation which, as represented, may correspond to the image data being mirrored horizontally across the display surface 22. Similarly, as depicted in FIG. 11B, the warning message 162 may identify that there is a fault in operation that has resulted in the image data being mirrored vertically across the display surface 22. Accordingly, the disclosure may provide for a variety of solutions to detect one or more faults in the operation of the display 10 and communicate such faults to a user of the display 12.

The above description is considered that of the preferred embodiments only. Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

In this document, relational terms, such as first and second, top and bottom, front and back, left and right, vertical, horizontal, and the like, are used solely to distinguish one entity or action from another entity or action, without necessarily requiring or implying any actual such relationship, order, or number of such entities or actions. These terms are not meant to limit the element which they describe, as the various elements may be oriented differently in various applications. Furthermore, it is to be understood that the device may assume various orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

It will be understood that any described processes or steps within described processes may be combined with other disclosed processes or steps to form structures within the scope of the present disclosure. The exemplary processes disclosed herein are for illustrative purposes and are not to be construed as limiting. It is also to be understood that variations and modifications can be made on the aforementioned methods without departing from the concepts of the present disclosure, and further it is to be understood that such concepts are intended to be covered by the following claims unless these claims by their language expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within at least one of 2% of each other, 5% of each other, and 10% of each other.

The invention claimed is:

1. A display device for a vehicle comprising:

a pixel array comprising a plurality of display elements;

at least one test element; and at least one controller configured to:

selectively activate the display elements of the pixel array via a plurality of control signals;

identify the activation of the at least one test element in response to at least one of the control signals; and identify a display fault of the display device by comparing the at least one control signal communicated to the at least one test element to a diagnostic signal communicated from the at least one test element;

wherein the operation of the at least one test element is monitored for display accuracy via one or more sensor elements disposed about the pixel array;

wherein the sensor elements include devices that are operable to detect the activity of one or more of the test elements; and the controller is configured to detect activity of the at least one test element in order to detect representative operation of a plurality of display elements.

2. The device according to claim 1, wherein the at least one test element forms a portion of the pixel array and is positioned along a perimeter of the pixel array.

3. The device according to claim 2, further comprising:

a mask extending along the perimeter of the pixel array and shielding the at least one test element from a display region of the display device.

4. The device according to claim 1, wherein the at least one test element comprises a non-illuminating test pixel configured to detect a voltage output from a transistor in response to the control signals.

5. The device according to claim 4, wherein the non-illuminating test pixel comprises an amplifier configured to detect the voltage output from the transistor and communicate the diagnostic signal identifying the voltage output to the at least one controller.

6. The device according to claim 1, wherein the at least one test element comprises at least one of the plurality of display elements and a light sensor.

7. The device according to claim 1, wherein the at least one test element comprises a light sensor; and wherein the light sensor is configured to detect an illumination level of the at least one of the plurality of display elements and communicate the diagnostic signal identifying the illumination level to the at least one controller.

8. The device according to claim 7, wherein the controller is configured to receive diagnostic signals from the light sensor.

9. The device according to claim 1, wherein the at least one test element and the plurality of display elements receive control and operation information over a shared communication interface.

10. The device according to claim 1, wherein the controller is configured to control a test program, which controls a lighting pattern of the at least one test element; and wherein, during the operation of the lighting pattern, the controller is configured to monitor the operation of the at least one test portion based on information captured and communicated from the one or more sensor elements.

11. The device according to claim 1, wherein the test elements share driving circuitry and data connections with the plurality of display elements; and wherein the test elements are operable to detect failures of one or more segments of the pixel array, orientation errors, display failures, color or radiance inaccuracies and other display failures.

12. The device according to claim 1, wherein at least one test element and at least one display element are connected to the same gate lines and source lines and the at least one test element and the at least one display element are both configured to respond similarly to inputs and to provide diagnostic information identifying the operation of the display elements.

13. The device according to claim 1, wherein the at least one test element comprises at least one non-illuminating test element configured to detect the operation of the display; and wherein the at least one non-illuminating test element is configured to detect the delivery of control signals and to output a diagnostic signal to the controller to identify the operation.

14. The device according to claim 13, wherein the at least one test element additionally comprises at least one illuminating test elements; and wherein the at least one illuminating test element is configured to monitor the operation of the display and to output a diagnostic signal to the controller to identify the error state.

15. The device according to claim 14, wherein the diagnostic information provides feedback that identifies operation of portions of the pixel array; and wherein the controller is configured to process the diagnostic signals to determine whether there is a failure of the display.

16. The device according to claim 15, wherein the controller is configured to, upon determining there is a failure of the display, one of deactivate the display and cause the generation of a notification that there is a failure of the display.

17. A method of detecting faults in a display device, comprising:

activating a display element of a pixel array via a plurality of control signals;

identifying the activation of at least one test element in response to at least one of the control signals;

monitoring the operation of the at least one test element for display accuracy via one or more sensor elements disposed about the pixel array;

detecting, by the sensor elements, the activity of one or more of the test elements; and detecting, by the controller, activity of the at least one test element in order to detect representative operation of a plurality of display elements;

comparing the at least one control signal communicated to the at least one test element to a diagnostic signal communicated from the at least one test element;

identifying a display fault of the display device based on the comparison of the control signal and the diagnostic signal.

18. The method according to claim 17, further comprising the steps of:

detecting, by at least one test element, a voltage output from a transistor in response to the control signal; and communicating the diagnostic signal identifying the voltage output to a controller.

19. The method according to claim 17, further comprising:

activating a backlight to emit light into a liquid crystal display panel;

detecting the light with a light sensor; and generating and communicating diagnostic signals to a controller.

* * * * *